United States Patent [19]

Schneider

[11] 4,395,835

[45] Aug. 2, 1983

[54] LIQUID RAINBOW

[76] Inventor: Ronald A. Schneider, 555 Pierce St. #303, Albany, Calif. 94706

[21] Appl. No.: 244,160

[22] Filed: Mar. 16, 1981

[51] Int. Cl.[3] ..... G09F 19/00

[52] U.S. Cl. ..... 40/406; 40/427; 40/581

[58] Field of Search ..... 40/406, 410, 412, 427, 40/439, 477, 581; 46/41, 156; 272/8 R, 8 D, 8 P, 8 N, 27 N; 434/102, 98

[56] References Cited

U.S. PATENT DOCUMENTS

| | | | |
|---|---|---|---|
| 894,509 | 7/1908 | Leupold | 40/562 |
| 2,480,902 | 9/1949 | Boyer | 434/98 |
| 3,365,816 | 1/1968 | Singerman | 434/102 |
| 3,706,149 | 12/1972 | Olivieri | 40/407 |
| 3,778,063 | 12/1973 | Strand | 434/102 |
| 3,964,194 | 6/1976 | Gugeler | 40/406 |
| 4,002,333 | 1/1977 | Gotoh | 40/407 |
| 4,057,921 | 11/1977 | Ball | 40/406 |
| 4,085,533 | 4/1978 | Ewald | 40/406 |

*Primary Examiner*—John J. Wilson

[57] ABSTRACT

Devices comprising a transparent chamber containing three mutually immiscible liquids two of which are colored yellow, cyan, or magenta with an external region colored yellow, cyan, or magenta. Static, they display four or more colored regions. When deformed or inverted, they create multicolor kinetic displays. Preferred devices comprise two liquid-filled, sheet-like chamberss in face to face relationship with five colored bands forming a rainbow pattern.

11 Claims, 1 Drawing Figure

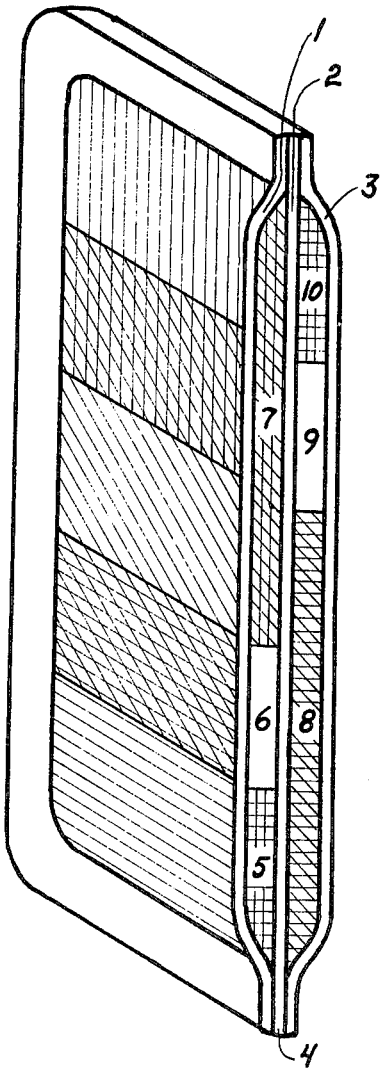
1
2
3
10
7
9
6
8
5
4

LIQUID RAINBOW

BACKGROUND OF THE INVENTION

This invention relates to decorative devices containing a plurity of mutually immiscible liquids for displaying colored patterns.

Rainbows, parts of rainbows, and rainbow-like designs are very popular in many parts of the world as decorative components in visual displays. Many devices have been described for producing rainbow-like effects or incorporating the colors of the rainbow in designs. Such designs and effects have invaribly been created either with solid materials or by shining colored lights on appropriate surfaces. Novel and interesting devices are always in demand for toys, novelties, and art objects.

Liquids can make interesting color effects because liquid movement creates many possibilities solid materials do not have. A rainbow design formed from a plurality of colored liquids would have many advantages in a decorative device. However, there has hitherto been no known way of creating a liquid rainbow wherein all the colors can interact and mix yet separate into a rainbow again on standing. A true rainbow effect would have at least five colors more or less resembling the colors red, orange, yellow, green, blue, and violet, and would have them in proper order with each color segregated from the others in its own band of color. In a liquid rainbow, the bands and colors would change when the liquids were moved and be reconstituted when the device was again at rest in its original position.

If five liquids are all confined in the same container and they are required to separate into five layers after mixing, the only known liquid systems which would do so are one wherein it is not possible to dye each layer a separate brilliant desired color. The systems which come closest to making five-component liquid rainbows are descrived in U.S. Pat. No. 4,085,533 and in my copending application Ser. No. 105,967, now abandoned. Both disclose systems of five immiscible liquid phases, some of which can be colored. In each case, however, at least one fluorocarbon layer is included. Fluorocarbons cannot in general be dyed, at least not by the common method of dissolving therein a commercial dye which has much lower solubility in all the other layers. Thus it is not presently feasible to make a liquid rainbow by confining five colored liquids in the same container.

In each liquid were confined in its own separate container, the attraction of liquidity would be lost, since the liquids could no longer form the attractive patterns and designs characteristic of liquid phases in contact with each other, as described in my copending application Ser. No, 105,966, now abandoned.

No other approaches to liquid rainbows were heretofore known.

A device is disclosed in U.S. Pat. No. 4,057,921 which, like the preferred embodiment of the present invention, comprises two transparent, sheet-like chambers fixed face to face, each containing a plurality of mutally immiscible liquids. However, all the embodiments and examples in that patent display when at rest only two colors. A two-color device, or even a three-color device, is clearly far removed from a liquid rainbow.

One object of the present invention is to provide a display device wherein at rest five colors of the rainbow appear in colored bands, while upon inversion or edformation yet other colors, shapes, and patterns become evident in a kinetic display.

Another object is to provide a liquid rainbow toy wherein no matter how thoroughly the liquids are mixed, they always separate back into a rainbow on standing.

Another object is to provide an object of art which can produce novel and fascinating colored patterns and movements.

Other objects and advantages of the invention will be apparent from the following description.

SUMMARY OF THE INVENTION

The present invention provides a novel display device comprising a chamber, the major portions of which are transparent, containing at least three mutually immiscible liquid phases at least two of which are colored either yellow, cyan, or magenta. A transparent region external to said liquids is also colored either yellow, cyan, or magenta.

Preferably, said external region consists of a second chamber containing at least two mutually immiscible liquid phases at least one of which is colored either yellow, cyan, or magenta. The description immediately following discusses in detail such a preferred two-chamber device.

In such a two-chamber device, it is preferred that the volumes of the liquid phases in the two chambers be selected such that when the device is vertical and at rest, one horizontal ray of light can pass through one liquid in one chamber and a second liquid in the second chamber; a second horizontal ray passing through the same two chambers can pass through a different combination of two liquids; a third horizontal ray passing through the same two chambers can pass through a third combination of two liquids; and a fourth horizontal ray passing through the same two chambers can pass through a fourth combination of two liquids.

It may not be obvious that a device of the above type can be a liquid rainbow. This can occur in the following way.

The color cyan is composed predominantly of blue and green light with relatively little red. Blue and red light in the relative absence of green combine to make magenta. Green and red light in the relative absence of blue combone to make yellow. These colors cyan, magenta, and yellow can be formed by passing white light through solutions of dyes which selectively absorb red, green, or blue light respectively.

If light is passed through a cyan colored solution and also through a magenta solution, the emerging light is blue. Similarly, cyan and yellow give green while magenta and yellow give red. By tinting the appropriate liquid layers cyan, magenta, or yellow, white light passing through the device can be made to emerge in colored bands forming a rainbow pattern, as detailed in the Examples and the Description of the Drawing.

Use of the colors cyan, magenta, and yellow is important for optimum visual effect. If one liquid passes red and green, one red and blue, and one green and blue, all possible colors can be formed by overlaying various thicknesses of the different liquids. The resulting display is visually rich, with a multitude of vivid colors.

If on the other hand most of both red and green are filtered out by one solution (which would therefore be blue) and blue and green are filtered out by another (which would therefoe be red), the color observed when light passes through first one solution then the other tends to be dull, dark, or muddy. The display is much less interesting and the variety of vivid colors that can be produced is greatly diminished. This effect was not appreciated by the inventor of U.S. Pat. No. 4,057,921 because the individual solutions in his examples are characterized by him as being blue, red, and yellow.

Preferred liquid phases for use in my invention are colored by dyes which strongly absorb one of the three colors red, green, and blue and transmit appreciable amounts of the other two, i.e. by dyes which are cyan, magenta, and yellow.

Light in the wavelength range from below 430 nm to about 480 nm is generally considered blue (or more properly, blue-violet). Green is from about 500 nm to about 560 nm. Red (including orange and more properly termed orange-red) is from about 590 nm to over 650 nm. The colors yellow, magenta, and cyan have maximum absorptions in the above ranges, respectively.

The color response of the normal human eye peaks at 450, 540, and 610 nm. For the clearest, brightest, and most attractive colors, absorbance of any single solution should peak near one of those wavelengths and transmittance should peak near the other two. Preferably, the perceived colors from the completed device should either be formed by one relatively narrow band of wavelengths centered near 450, 540, or 610 nm (formed by light passing through two different solutions) or should be the result of combinations of two such bands.

The ability of the human eye to perceive wavelengths above about 640 nm or below about 440 nm falls off fairly rapidly, and for most people the absorption spectrum below about 420 nm or above about 660 nm contributes very little to the perceived color.

Using the above guidelines, dyes may either be selected based on their absorption curves, as in Example 2, or by visual examination and trial and error.

The human eye is remarkably subtle in the gradations of color it can perceive, and in the subjective way it perceives color. When colors such as blue are referred to herein, it should be understood that any of a number of wavelength distributions and any of a wide range of shades and hues might be so described, the common factor distinguishing them as blue being that all are relatively enriched in at least some wavelengths below about 480 nm.

The perceived colors are to some extent dependent upon the surroundings or backgrounds against which they are perceived. Thus light passed through a strongly absorbing cyan solution and then through a weakly absorbing magenta solution would be blue against the background of the cyan solution, but cyan against an intense blue background. It is possible to have a number of different colored bands all of which fall under the same generic color description, as for example the different layers of red in Example 6.

Preferably, the colors should be reasonably intense, since the device is most attractive with intense colors. Often it is difficult to find soluble coloring agents which will color one solution intensely and the others such a small amount as not to interfere with desired color band formation.

Preferably, the transmittance at 450, 540, and 610 nm for each colored solution, measured horizontally when the long axis of the device is vertical, should be greater than 10% for two of those wavelenghts and less than 5% for the remaining one, as in Example 5. More preferably, itf should be greater than 20% for two and less than 2% for the remaining one. Preferably, two of said transmittances should be greater than the third by at least about a factor of ten, as in Examples 2 and 5. Preferably, the optical density at the wavelength of maxium absorption should be greater than about 2. Preferably, light emerging from the device after passing through two solutions should transmit more than 10% of the light at one or two of the wavelengths 450, 540, and 610 nm and less than 5% at the others, as in Example 2.

For the liquids, any systems of three mutually immiscible transparent liquid phases compatible with the container may be used. Some suitable systems are described below in the Examples.

Mutually immiscible liquids are those which after extended contact with one another maintain separate liquid phases at equilibrium. No matter how thoroughly the liquids are mixed by manipulation of the device, they will always separate into the same number of layers on standing. This effect adds considerable interest to the liquid rainbow device because one can observe various color effects as the liquids are mixed and then with the device at rest one can continue to watch as liquid portions slowly move and coalesce to recreate the layers.

Use of at least three mutually immiscible liquid phases confined in the same chamber is an essential element in this invention. The colored kinetic display effects achieveable cannot be obtained in any other way.

Preferably, the liquids should be relatively easy to color with stable dyes that have little solubility in all the other phases. Preferably, the liquid phases should have sufficiently different densities that they separate rapidly after mixing and have a minimum tendency to form lasting emulsions. Preferably the liquids should be transparent, inexpensive, not toxic, not flammable, not combustible, and not corrosive.

The visual effects producible with the devices of this invention depend upon the geometry, transparency, and flexibility of the chambers and the color, viscosity, density, transparency, index of refraction, and surface tension of the liquids. The patterns change more slowly the more viscous the liquids.

The liquid phases can be combined whenever desired with gas or solid phases. However, it is preferred that the chambers contain either no gas at all or else only small bubbles, since the liquid patterns produced upon movement or deformation of the device are generally more interesting in the absence of large amounts of gases. The present invention makes possible the creation of five or more colored bands with each chamber completely filled with liquid.

The number of liquid phases in each chamber should preferably be at least three. The more liquid phases there are, and the more different colors can be created by superimposing pairs of liquids, the more interesting is the device.

The number of liquid-containing chambers should preferably be no more than two, both for simplicity of fabrication and because the most pleasing aesthetic effects are usually created with only two chambers. With more than two, there is a tendency upon movement of the device for too many colors to overlap and present a confusing display. However, larger numbers of chambers can be used as desired, and can sometimes create effects impossible with only two, as in Example 8.

The chambers may be of almost any shape and size and material so long as major portions are substantially transparent and a ray of light can shine sequentially through both. Preferred, however, are sheet-like chambers. Preferably, the interior space should be less than one-tenth as thick as it is wide. Preferably, the chambers are formed by sealing together substantially parallel, transparent sheets. Preferably, the sheets are of thermoplastic material such as poly(methyl methacrylate) or poly(vinyl chloride).

The word transparent is meant to include everything which transmits rays of light, including materials which are translucent. Optical clarity is desirable, however. Translucent materials are less preferred than materials of high optical clarity.

Preferably, the chambers are in face to face relationship. Preferably, the faces are directly opposite each other and neither chamber extends out beyond the other, but it is also possible to have the chambers face to face but displaced somewhat so they do not overlap in all places. Preferably, one substantially flat side of one chamber should be touching or nearly touching or coincident with one substantially flat side of the other chamber.

Preferably, two chambers have a common wall. Preferred devices are formed by sealing three sheets of transparent material together at the edges. If desired, sheets of thermoplastic may be thermoformed to create the desired chambers. Another approach is to use planar, rigid sheets with spacers along the edges as appropriate.

In one variant of my invention, the walls of the chambers are flexible as disclosed in my copendingapplication Ser. No. 105,966.

By varying the geometry and orientation of the chambers, the volumes of the liquids, and the color or lack of color of each liquid, varying numbers of differently colored bands can be created. Preferably, the device displays at least four bands of color when it is at rest and in equilibrium in a vertical position, illuminated with white light. For best results, the white light should shine through the device from behind.

More preferably five colored bands can be perceived. The more bands of different colors there are the greater is the aesthetic, decorative, and amusement value of the device. Preferably, each color of every band is different from that of every other band.

Preferably, the perceived color of each band is some shade of either yellow, cyan, magenta, red, green, or blue. More preferably, the bands form a rainbow pattern. Patterns which are more of less reminiscent of rainbows are demostrated in Examples 1, 2, 3, 4, 5, and 7. The more preferred rainbow patterns include red, yellow, green, and blue and have a fifth band of either magenta or cyan. The preferred order of the colors in rainbow patterns is magenta, red, yellow, green, cyan, blue, and magenta. Especially preferred is a pattern including red, yellow, cyan, and blue, in that order (as in the drawing), optionally with magenta at either end. Preferably, the colored liquids are distributed between chambers in such a way that when the device is moved, as for instance by turning it upside down, squeezing it, or holding it horizontal, the colors of one chamber can overlap the colors of the other chamber to create each of the colors red, blue, and green by superposition of yellow and magenta, cyan and magenta, and yellow and cyan respectively. The ability to form all those colors greatly adds to the novelty and aesthetic value of the device, and makes it much more interesting than devices which connot create such a spectrum of color.

Preferably, each of the colored bands is created by light passing successively through two different liquids, since in this way the richest and most interesting kinetic displays are created when the device is deformed or inverted.

Alternatively, one or more of the colored bands may be formed by light passing through only one liquid. In the extreme, the device may consist of only one chamber, every band being formed by light passing through only one liquid and then through some other appropriately tinted, transparent, external region, although this is less preferred.

In the above disclosure, the more preferred two-chamber device was described in detail. When the device consists of only one chamber, the static rainbow patterns described above can be replicated by covering the chamber with transparent solid bands of color where the colored liquids of the second chamber would have been. For example, sheets of Chartpak ® transparent adhesive color film may be used. Alternatively, other films or coatings could be applied to the surface of the chamber, or the material of which the chamber wall is composed might be tinted, or a detachable transparent cover could be applied.

Although the appearance of a resting one-chamber device can thus be made very similar to a two-chamber one, upon movement of the device the observed effects are very different. The complex interplay of multiple overlappong liquids is absent from the one-chamber device. Nevertheless, though less preferred, liquid rainbows can be made with only one chamber, and they do still show interesting kinetic effects upon movement, although the kinetic effects are less complex than in the two-chamber case.

DESCRIPTION OF THE DRAWING

The drawing is an isometric view of a typical device according to the invention with one portion shown broken away. Transparent, sheet-like walls 1, 2, and 3 enclose two separate chambers in face to face relationship, wall 2 being common to both chambers. The walls have been sealed together around the edges, as at point 4, to form a liquid-tight seal.

The chamber on the left is filled with three mutually immiscible liquids 5, 6, and 7. The chamber on the right is filled with three other mutually immiscible liquids 8, 9, and 10. Liquids 5 and 10 are magenta; i.e. they transmit both red and blue light, red being indicated in the drawing by vertical hatching and blue by horizontal hatching. Liquid 8 is a cyan, transmitting blue and green. Liquid 7 is yellow, transmitting red and green. Liquids 6 and 9 are substantially colorless.

The yellow layer (7) is approximately three times as high as the other two in that chamber. The cyan layer (8) is approximately three times the height of the other two in its chamber.

When the device is vertical, as drawn, and is viewed from the outside with white light shining through from the back, five colored bands are perceived, each approximately the same height, as shown. From bottom to top, they are blue, cyan, green, yellow, and red.

A ray of white light entering this device perpendicular to its plane and near the bottom would pass sequentially through cyan and magenta and emerge blue. A second such ray higher up would pass through two different liquids but only one color, cyan. It would emerge cyan. This would be true whether the middle layer in the chamber on the left were colorless, as shown, or were the color cyan. A third such ray through the middle would pass through cyan and yellow and emerge green, while a fourth such ray higher up would pass through yellow and emerge yellow, and so forth.

EXAMPLES

The folowing examples serve only to illustrate certain aspects of the invention and not to limit its scope.

Example 1. In a 10 mL graduated cylinder, (a) 2.4 mLof a solution of 7 mg of phenolphthalein, 2 g of sodium carbonate, and 100 mL of water, (b) 2.3 mL of a solution of 40 g of paraffin oil and 20 g of 1-bromohexadecane, and (c) 5.3 mL of a solution of 24 mg of Capracyl Yellow GWP ® (du Pont) in 100 mL of isobutanol were shaken thouroughly and allowed to separate. The bottom solution was magenta, the middle nearly colorless, and the top yellow, with volumes of about 2 mL, 2 mL, and 6, mL respectively.

Another 10 mL graduated cylinder, (a) 5.4 mL of a solution of 4 g of cupric acetate monohydrate, 1 g of acetic acie, and 100 mL of water, (b) 2.0 mL of a solution of 40 g of paraffin oil and 20 g of 1-bromohexadecane, and (c) 2.6 mL of a solution of 20 mg of Irgacet Rubine RL ® (Geigy) in 100 mL of isobutanol were shaken thoroughly and allowed to separate. The bottom solution was cyan, the middle nearly colorles, and the top magenta with volumes of about 6 mL, 2 mL, and 2 mL respectively.

To form a suitable container, a 30 mil (0.8 mm) Teflon ® sheet $2\frac{1}{4}\times 7$ inches ($6\times 18$ cm) was placed on top of a sheet of 20 mil (0.5 mm) rigid poly(vinyl chloride) $3\frac{1}{2}\times 5\frac{3}{8}$ inches ($9\times 14$ cm) so that their center lines were coincident and about $\frac{1}{2}$ inch (slightly over 1 cm) of PVC was exposed at the end of the Teflon. This exposed portion was to from the bottom of the device. A second PVC sheet like the first except $\frac{1}{8}$ inch (3 mm) longer was placed on top of the Teflon spacer so that the bottom ends of the PVC sheets coincided. A second Teflon spacer was placed on top, then a third PVC sheet like the first, with its bottom end aligned with the other two.

The bottom and two sides were sealed with a hydraulic press at 250° F. (120° C.). The spacers were withdrawn and each chamber was filled with the contents of one of the cylinders specified above. Small portions of some of the liquids were withdrawn to make a more attractive distribution of colored bands. The top was then sealed as the sides had been.

When the resulting device was vertical and at rest, it had the appearance of a rainbow. Five bands of color were seen, red, yellow, green, cyan, and blue from top top bottom.

If an air space was left above the yellow liquid, a sixth band, of magenta, could be formed. If the device was sealed in such a way that the chamber holding the contents of the first cylinder extended below the bottom of the chamber holding the contents of the second cylinder, an additional band, of magenta, could be formed. If the bottoms of the two chambers were coincident, an additional band could be formed by adding a fluorocarbon to one of the chambers. If only a few drops of fluorocarbon were added, then little drops or balls of color were formed.

When the device was turned upside down, the colors flowed, extending themselves in pseudopods, blobs, and channels, continuously exposing new and changing colors and patterns in an intriguing kinetic display. Other liquid motions could be induced by squeezing or flexing the device, greatly increasing the variety of effects obtainable, as observed in my copending application Ser. No. 105,966.

If the middle layer of the contents of the second chamber was colored yellow without greatly altering the colors of the other two layers, as for example by adding Oil Yellow 3G ® (Allied Chemical), the appearance of the device at rest was substantially unchanged. Its appearance when the liquids were in motion, however, was different in those transient regions where the new yellow layer overlapped non-yellow layers in the other chamber.

Example 2. Two identical sheets of window glass are placed parallel to each other and directly opposite each other and are separated by spacers along all the edges. All edges are sealed liquid-tight with epoxy resin except for small hole through which liquid can be introduced and which can be subsequently sealed over.

One chamber formed as above is filled with transparent, mutually immiscible liquids A (on the bottom), B (in the middle), and C with volume ratios 1:2:2 respectively. A second identical chamber is filled with liquids D (on the bottom), E (in the middle), and F with ratios 2:2:1.

Each liquid is tinted with a dye which has an absorption spectrum consisting of a single peak. The concentrations are such that the optical densities of all solutions at the absorption maxima are 2.0. The absorption maximum, the wavelength below which the optical density is less than half the maximum, and the wavelength above which the optical density is less than half the maximum, in nanometers, follow for each of the liquids: A, 540, 480, 610 (magenta); B, 660, 580, 700 (cyan); C, 450, 400, 500 (yellow); D, 620, 570, 660 (cyan); E, 400, less than 400, 460 (yellow); F, 560, 460, 590 (magenta).

The complete device is formed by fixing the two chambers face to face. The percent transmittance at 450, 540, and 610 nm follows for each of the liquids and for each of the pairs of liquids which forms colored bands in the completed device: A, 23, 1, 10; B, 46, 38, 3; C, 1, 57, 95; D, 70, 32, 1; E, 10, 91, 95; F, 14, 1, 35; A+D, 16, 0.3, 0.1 (blue); B+D, 32, 12, 0.2 (cyan); B+E, 5, 35, 3 (green); C+E, 0.1, 52, 90 (yellow); C+F, 0.1, 0.6, 33 (red).

When the device is vertical and at rest and viewed from the sied in white light, it shows a rainbow pattern similar to that in Example 1 and in the drawing.

Example 3. Surlyn ® sheet of 30 mil thickness is cut into $8\times 13$ cm pieces. Three pieces are stacked one on top of another and heat sealed along three edges with a hydraulic press at 120° C.

One of the resulting chambers is filled with the first-mentioned equilibrated three-phase mixture of Example 1 using 4 mL of the magenta liquid, 2 mL of the colorless liquid, and 4 mL of the yellow liquid.

A three phase system is produced by shaking a mixture of equal volumes of heptane, a solution of 10 mg of Luxol Fast Blue MBSN ® (du Pont) in 40 mL of acetone, and an aqueous 27% by weight solution of ammonium sulfate. The second chamber in the Surlyn device is filled with 2 mL of the bottom (colorless) liquid, 4 mL of the middle (cyan) liquid, and 2 mL of the top (colorless) liquid.

The top edge is then heat sealed, leaving small air bubbles in each of the chambers. Because the device is flexible and because the distance between the walls at rest tends to vary from place to place because of differences induced during heat sealing, the colored bands formed by the completed device vary with the orientation and deformation of the device. In general, bands or regions with the colors magenta, blue, cyan, green, and yellow should be readily apparent. Thus five colored bands can be produced using only three colored solutions.

Variations in color and interesting patterns can be obtained by bending, flexing, and squeezing the device.

Since the top liquid in one compartment is colorless, a somewhat similar effect when the device is at rest can be produced by replacing the top liquid with air. Even at rest, however, the density and surface tension and index of refraction differences cause differences in appearance. Differences become even more apparent when the liquids are in motion. The device with three liquids in each compartment in general gives the better results.

Example 4. In a graduated cylinder, 20 mL of m-xylene, 20 mL of paraffin oil, 30 mL of isopropanol, 10 mL of Pluracol TP-740® (BASF), and 30 mL of 10% of auqeous sodium chloride solution were shaken together and allowed to separate. Three layers resulted which will be termed i, ii, and iii from bottom to top, with volums of 33, 42, and 33 mL respectively.

Three sheets of poly(methyl methacrylate) 1/16 inch (1.6 mm) thick and 6 inches (15 cm) square were oriented parallel to each other and face to face, separated along the edges by 1/16 inch spacers of the same material. The edges were solvent bonded to form a liquid-tight seal. One of the resulting chambers was filled about 40% of the way with i tinted cyan and about 40% with ii tinted yellow. The top 20% was left filled with air. The other chamber was filled about 20% with i tinted magenta, about 40% with ii to which no dye was purposely added, and about 40% with iii tinted magenta.

When the resulting device was vertical and at rest, five colored bands were seen, magenta, red, yellow, cyan, and blue from top to bottom.

Example 5. Chambers formed as in Examples 2 and 4 are filled, in order of decreasing density, with liquid layers i, ii, and iii as follows. One chamber is filled 2/7 with i tinted magenta, 1/7 with ii not purposely tinted, 3/7 with iii tinted yellow, and 1/7 with air. The other chamber is filled 1/7 with perfluoro-1-methyldecalin, 3/7 with i tinted cyan, 1/7 with ii tinted yellow, and 2/7 with iii tinted magenta.

When only one chamber is filled and the other is empty, transmittance of each colored solution measured horizontally when the device is vertical is given in the following table:

| | Transmittance, % | | | |
|---|---|---|---|---|
| Wavelength, nm | Bottom Magenta Solution | Top Magenta Solution | Either Yellow Solution | Cyan Solution |
| 420 | 22 | 11 | 0.6 | 22 |
| 440 | 32 | 15 | 0.6 | 79 |
| 450 | 26 | 13 | 0.6 | 87 |
| 460 | 17 | 10 | 0.6 | 88 |
| 480 | 5 | 5 | 0.9 | 81 |
| 500 | 1.4 | 3 | 4 | 71 |
| 520 | 0.6 | 1.7 | 13 | 48 |
| 540 | 0.6 | 1.2 | 21 | 20 |
| 560 | 0.7 | 1.3 | 25 | 4 |
| 580 | 1.3 | 3 | 29 | 0.7 |
| 600 | 45 | 14 | 32 | 0.6 |
| 610 | 60 | 29 | 34 | 0.5 |

-continued

| | Transmittance, % | | | |
|---|---|---|---|---|
| Wavelength, nm | Bottom Magenta Solution | Top Magenta Solution | Either Yellow Solution | Cyan Solution |
| 620 | 66 | 47 | 36 | 0.6 |
| 640 | 75 | 68 | 39 | 0.8 |
| 660 | 75 | 76 | 42 | 1.5 |

When this device is vertical and at rest, seven colored bands are perceived: magenta, red, yellow, green, cyan, blue, and magenta. The colors of this device are more striking than those of Example 1 because the colors are more vivid, which in general is to be preferred.

Example 6. One chamber with transparent, rigid, sheet-like, parallel walls is filled with equal amounts of (a) a dense magenta liquid of maximum optical density 0.5, (b) a less dense, mutually immiscible magenta liquid of maximum optical density 1.0, and (c) and even less dense, mutually immiscible magenta liquid of maximum optical density 1.5. A second similar chamber is filled with equal amounts of (a) a dense yellow liquid of maximum optical density 1.5, (b) a less dense, mutually immiscible yellow liquid of maximum optical density 1.0, and (c) an even less dense, mutually immiscible yellow liquid of maximum optical density 0.5.

The two chambers are fixed parallel to each other and touching each other face to face in such a way that the top of the yellow chamber is 1/6 of the way down from the top of the magenta container. Oriented vertically, seven bands of color are observed, each different from any of the others, starting from deep magenta at the top and progressing through hues such as claret, crimson, ruby, scarlet, and orange to deep yellow at the bottom. These same various hues could be formed in a flexible device containing only one magenta liquid in one chamber and one yellow liquid chamber by varying the relative thicknesses of the two liquids.

Example 7. Chambers are fabricated in the manner of Example 1 except that four PVC sheets are used and three chambers result. The bottom $\frac{1}{4}$ of the first chamber is filled with a solution dyed magenta wherein the magenta hue is relatively blue, the middle $\frac{3}{8}$ with a cyan solution wherein the light absorption is relatively weak, and the top $\frac{3}{8}$ with a colorless solution, all three solutions being mutually immiscible. The bottom $\frac{1}{8}$ of the second chamber is colorless, the lower middle $\frac{3}{8}$ is filled with a cyan solution wherein the light absorption is relatively strong, the upper middle $\frac{3}{8}$ is filled with a yellow solution, and the top $\frac{1}{8}$ is colorless. The bottom $\frac{3}{8}$ of the third chamber is colorless, the middle $\frac{3}{8}$ is filled with a yellow solution, and the top $\frac{1}{4}$ with a magenta solution wherein the magenta hue is relatively red.

When the device is vertical and at rest, eight bands of color can be observed, all more or less in the order of the rainbow. From top to bottom, they are violet-red, orange-red, yellow, yellowish-green, green, greenish-blue, violet-blue, and violet. Shades and hues can be adjusted by changing the relative thicknesses of the liquids or the concentrations or absorption spectra of the dyes.

Instead of using liquids for the colorless portions at the bottom, the chamber could simply be sealed off in that region. Instead of using colorless liquids at the top, air could be substituted. The use of liquids, however, generally gives more interesyting visual results upon movement of the device.

Example 8. The first described magenta, colorless, and yellow liquids of Example 1 are put in a 2-dram (8 mL) vial in the ratio 1:1:4 bottom to top. The second described liquid mixture of Example 1 is prepared except that only 7 mg of Irgacet Rubine RL is used. This latter mixture is put in another 2-dram vial in the ratio 4:1:1. A third liquid mixture is prepared by mixing and shaking equal volumes of a solution of 10 mg of Luxol Fast Blue MBSN in 40 mL of acetone with a solution of 0.2 g of potassium dichromate and 30 g of potassium carbonate in 30 g of water. A third 2-dram vial is filled with equal amounts of the resulting two liquids.

The three vials are oriented vertically and attached to each other side by side so that each vial is symmetrically touching the other two. When the resulting device is rotated slowly about its central axis, the following color combinations come sequentially into view. Colors are listed bottom to top and followed by the ratios of the heights of the bands. Left side: magenta, colorless, orange-yellow (1:1:4); red, light yellow, orange-yellow, green (1:1:1:3); light yellow, cyan (3:3); green, deep turquoise, light turquoise, blue-violet (3:1:1:1); cyan, colorless, magenta (4:1:1); and blue, cyan, green, orange-yellow, red (1:1:2:1:1). Simultaneously on the right side the same color combinations appear, but in a different order.

As the range of embodiments of this invention is wide, and many may appear to be widely different, yet not depart from the spirit and scope thereof, it is to be understood that this invention is not limited to the specific embodiments thereof, except as defined in the appended claims.

I claim:

1. A display device comprising two transparent sealed sheet-like chambers in face to face relationship containing colored liquids, (A) one chamber containing at least three multually immiscible liquid phases at least two of which are colored with colors selected from the group consisting of yellow, cyan, and magenta, and (B) a second chamber containing at least two mutually immiscible liquid phases at least one of which is colored with colors selected from the group consisting of yellow, cyan, and magenta, the volumes of said liquid phases being selected such that when the device is vertical and at rest, each of said at least two liquid phases in said second chamber are in overlapping relationship with at least two of the liquid phases in said one chamber, such that one horizontal ray of light can pass through one liquid in one chamber and a second liquid in the second chamber; a second horizontal ray passing through the same two chambers can pass through a different combination of two liquids; a third horizontal ray passing through the same two chambers can pass through a third combination of two liquids; and a fourth horizontal ray passing through the same two chambers can pass through a fourth combination of two liquids.

2. The device of claim 1 consisting of less than three liquid-containing chambers, such that when the decive is vertical and at rest and illuminated with white light, at least four bands of color can be perceived, each color different from any of the other three and a member of the group consisting of red, yellow, green, cyan, blue, and magenta.

3. The device of claim 2 wherein the observed colors form a rainbow pattern.

4. The device of claim 1 wherein when the device is vertical and at rest and illumunated with white light, at least five bands of color can be perceived, each of the five colors being different from any of the other four.

5. The device of claim 4 wherein the perceived colors include red, yellow, green, cyan, and blue, in that order.

6. The deive of claim 4 wherein the interior space in each chamber is less than one-tenth as thick as it is wide, and the path of light rays forming each of at least five bands of color passes sequentially through one liquid in one chamber and then another liquid in a second chamber.

7. The device of claim 6 wherein the perceived colors include red, yellow, green, cyan, and blue, in that order, and the device consists of no more than two sheet-like, liquid-containing chambers.

8. The device of claim 1 wherein said overlapping colors synthesize red, blue, and green by the superposition of yellow and magenta, cyan and magenta, and yellow and cyan.

9. The device of claim 1 wherein the interior space in each chamber is less than one-tenth as thick as it is wide, said one chamber contains three mutually immiscible liquid phases, the top liquid having a color selected from the group consisting of yellow, cyan, and magenta, the bottom liquid having a color selected from the group consisting of those two colors not selected for the top liquid, and the middle liquid being substantially colorless, tinted by the colors of the two adjacent layers to only a minor extent, and said second chamber contains at least two mutually immiscible liquid phases at least one of which is colored a color selected from the group consisting of yellow, cyan, and magenta, said color being one not selected for any layer of any other chamber.

10. The device of claim 1 wherein at least five liquid phases are colored with the colors being selected from the group consisting of yellow, magenta, and cyan.

11. The device of claim 1 wherein when the device is vertical and at rest, white light passing through it horizontally emerges (a) from one section with more that 10% of the light having been transmitted at one wavelength selected from the group consisting of 450, 540, and 610 nm, and less than 5% of the light having been transmitted at the other two wavelengths, and (b) from another section with more than 10% of the light having been transmitted at a different one of said wavelengths and less than 5% having been transmitted at the other two, and (c) from another section with more than 10% of the light having been transmitted at two of said wavelengths and less than 5% at the third, and (d) from yet another section with more than 10% of the light having been transmitted at a different two of said wavelengths and less than 5% at the third.

* * * * *